US008050147B2

(12) United States Patent
Campbell

(10) Patent No.: US 8,050,147 B2
(45) Date of Patent: Nov. 1, 2011

(54) DEVICE INCORPORATING BOTH TIME KEEPING AND STATIC ADJUSTMENT DIALS FOR DETERMINING FEEDING TIMES AND POSITION

(75) Inventor: Aindrea McKelvey Campbell, Beverly Hills, MI (US)

(73) Assignee: The Anthena Company, LLC, Beverly Hills, MI (US)

( * ) Notice: Subject to any disclaimer, the term of this patent is extended or adjusted under 35 U.S.C. 154(b) by 0 days.

(21) Appl. No.: 12/540,608

(22) Filed: Aug. 13, 2009

(65) Prior Publication Data

US 2010/0074058 A1 Mar. 25, 2010

Related U.S. Application Data

(60) Provisional application No. 61/099,026, filed on Sep. 22, 2008.

(51) Int. Cl.
*G04B 19/04* (2006.01)

(52) U.S. Cl. ..... 368/80; 368/46

(58) Field of Classification Search ..... 368/70, 368/71, 80, 96

See application file for complete search history.

(56) References Cited

U.S. PATENT DOCUMENTS

| | | | | |
|---|---|---|---|---|
| 4,338,680 | A | 7/1982 | Nomura | |
| 4,505,595 | A | 3/1985 | Rose et al. | |
| 4,972,391 | A | 11/1990 | Juve et al. | |
| 5,691,932 | A | 11/1997 | Reiner et al. | |
| 7,134,784 | B1 * | 11/2006 | Marin | 368/295 |
| 2005/0249044 | A1 * | 11/2005 | Forsey et al. | 368/110 |
| 2007/0201316 | A1 * | 8/2007 | Shu | 368/223 |
| 2009/0109798 | A1 * | 4/2009 | West et al. | 368/10 |

FOREIGN PATENT DOCUMENTS

DE 10129621 A1 1/2003

OTHER PUBLICATIONS

Coast Innovations' itzbeen baby care timer, 3 printed pages, including downloaded product instructions, from http://www.itzbeen.com (believed to have been offered for sale, publicly used and/or published prior to the filing of this application).

* cited by examiner

*Primary Examiner* — Renee S Luebke

*Assistant Examiner* — Jason Collins

(74) *Attorney, Agent, or Firm* — Gifford, Krass, Sprinkle, Anderson & Citkowski, P.C.

(57) ABSTRACT

A breastfeeding assist timepiece includes a housing containing a first live time display and a second resettable static time display. A left/right side indicator is defined at a further location of said housing. In use, the static time display is continuously reset to a time of a most recently completed feeding, with the left/right side indicator further designating a left or right breast employed first in the most recent feeding and in order to more accurately predict the timing of a present or future feeding, as well as which breast to be initially employed in that feeding.

5 Claims, 6 Drawing Sheets

DEVICE INCORPORATING BOTH TIME KEEPING AND STATIC ADJUSTMENT DIALS FOR DETERMINING FEEDING TIMES AND POSITION

CROSS-REFERENCE TO RELATED APPLICATIONS

This Application claims the benefit of U.S. Provisional Application 61/099,026 filed on Sep. 22, 2008.

FIELD OF THE INVENTION

The present invention relates generally to a timepiece device for use by breast feeding mothers. More particularly, the present invention discloses a wearable breastfeeding watch, and which includes a first live time display and a second dummy and iteratively reset display. A Left/Right display is also provided and which, when set to a side in which a most recent feeding initiated, assists in establishing a dual-breast feeding cadence, and which allows the user to resume a future feeding such as with the alternate breast.

BACKGROUND OF THE INVENTION

Timer devices are well known in the relevant art. A particular subset species of timers specifically deals with baby care timers, such as reminding iterative feeding and napping times.

The itzbeen baby timer teaches a portable device with up to four digital timers, such as which can correspond to changing, feeding, sleeping, and medication schedules. Of note, the itzbeen device includes a nursing reminder with a left/right side indicator.

A related disclosure teaching a breast feeding timer is described in Juve U.S. Pat. No. 4,972,391 and incorporates an electronic circuit for counting an elapsed time in minutes succeeding a previously initiated nursing session. The elapsed time is presented upon a visual display which also includes a left/right side breast sub-display for indicating the breast from which the baby was last fed. The timer also includes a reference clock, clock counter, alarm counter and three digit digital display including separate right/left sub-displays, and an audible alarm.

German reference DE 101 29 621 teaches a breast feeding watch with an analog face and within which is set twin digital dynamic displays, each being a chronograph dynamically displaying the duration of time since the last feeding from either a left or right side breast.

Reiner U.S. Pat. No. 5,691,932 teaches a care giver data collection and reminder system for providing a range of baby care information entry fields, among them including feeding times and left/right side breast indicator.

Additional references of note include Nomura U.S. Pat. No. 4,338,680, which teaches an earlier version of analog display watch with digital inset for displaying alarm time information as well as the dual timing event stopwatch of Rose U.S. Pat. No. 4,505,595.

SUMMARY OF THE INVENTION

The present invention discloses a wearable breastfeeding wristwatch which is an improvement over prior art breastfeeding watches and timer devices in that it provides a more convenient display and user functionality for comparing a current elapsing time with a static display time, combined with a left/right indicator for determining the breast employed in a previous feeding session. The present invention further discloses a series of additional variants incorporating any of a number of features including superimposed analog displays on a dial face, a left/right display incorporated into a rotating bezel, a static time display incorporated into either an analog or digital inset, as well as assorted digital displays including combining a digital static time indicator with left and right side breast indication, this being manually set through activation of lower positioned push buttons.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
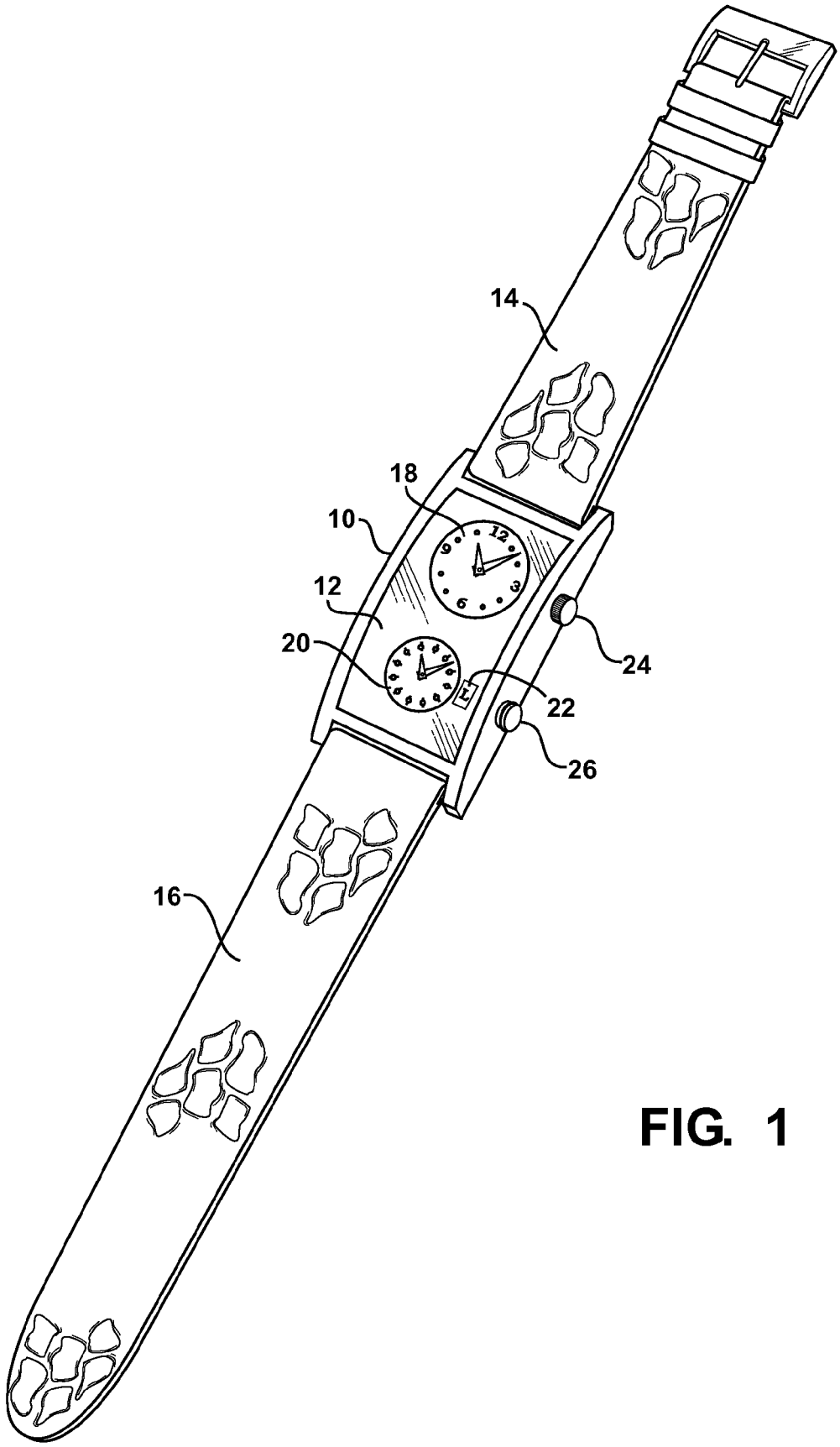
FIG. 1 is an environmental perspective view of the breast feeding watch according to one preferred embodiment of the present invention.

Referring to FIG. 1, the present invention discloses a wearable breastfeeding watch including a timepiece casing 10 exhibiting a display face 12 and further showing first 14 and second 16 end engageable straps portions extending from opposite ends of the casing. As further shown, the display face 12 includes a first (live or dynamic) analog time display 18 and a second likewise analog (dummy or static) and iteratively resettable display 20. Although not described in detail, it is understood that the breastfeeding watches, according to any of the embodiments disclosed herein, incorporates suitable gear geometry and/or digital processing components for providing optimal functionality.

A Left/Right indicator 22 is also provided and which, when set to a side in which a most recent feeding occurred, assists in establishing a dual-breast feeding cadence, and which allows the user to resume a future feeding such as with the other breast. Also shown at 24 is a first pull out and reset dial associated with the live display 18, and further at 26 is a second two position reset dial for controlling, in a first pull-out position, the left or right side indicator 22 and, in a second further pull-out position, the reset static time 20. Other envisioned variants include the two-position reset dial controlling in one pull-out position, either of the reset static time 20 or right/left side indicator 22. The terms dial, crown and knob are also understood to be used interchangeably when referencing the elements 24 and 26.

The incorporation of the device as a wearable timepiece is a preferred application, and given the high degree of mobility which normally attends daily life. That said, it is also envisioned that the timepiece device can also be provided as a table-top display, such as positioned proximate a feeding chair and in instances where a prolonged period of successive feedings are intended to occur at a static location.

The timepiece, according to other desired embodiments, can also constitute such as a wearable pendant, and such as which can be utilized in combination with a chain or the like (not shown). As is also known, a battery (e.g. lithium ion) or other portable power source is provided for operating the live/dynamic display, as well as any digital aspects associated with the static display or left/right indicator and as will be subsequently described in more detail with reference to the alternate variants of FIGS. 9 and 10.

Figure 2:
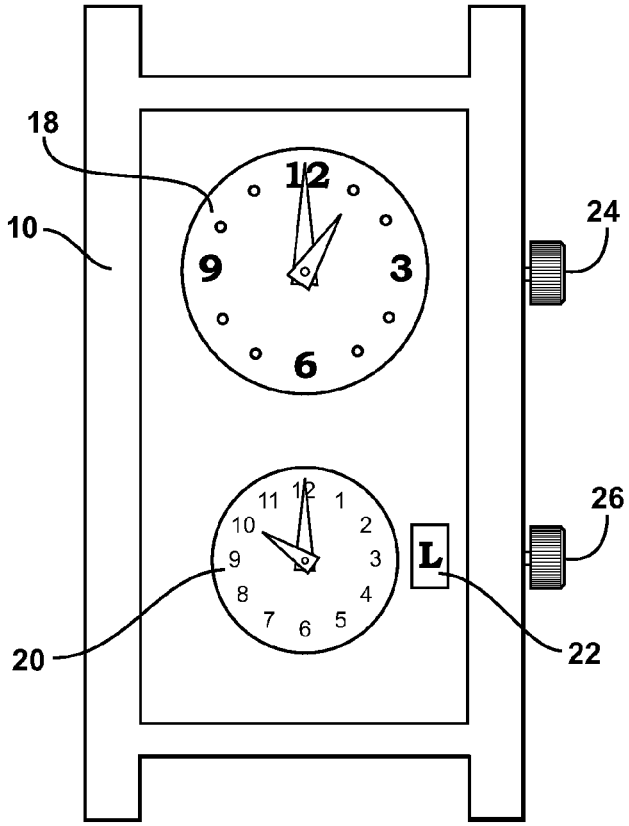
FIG. 2 is an illustration of a timepiece device according to the present invention, and by which an upper display indicates a current time.
Figure 3:
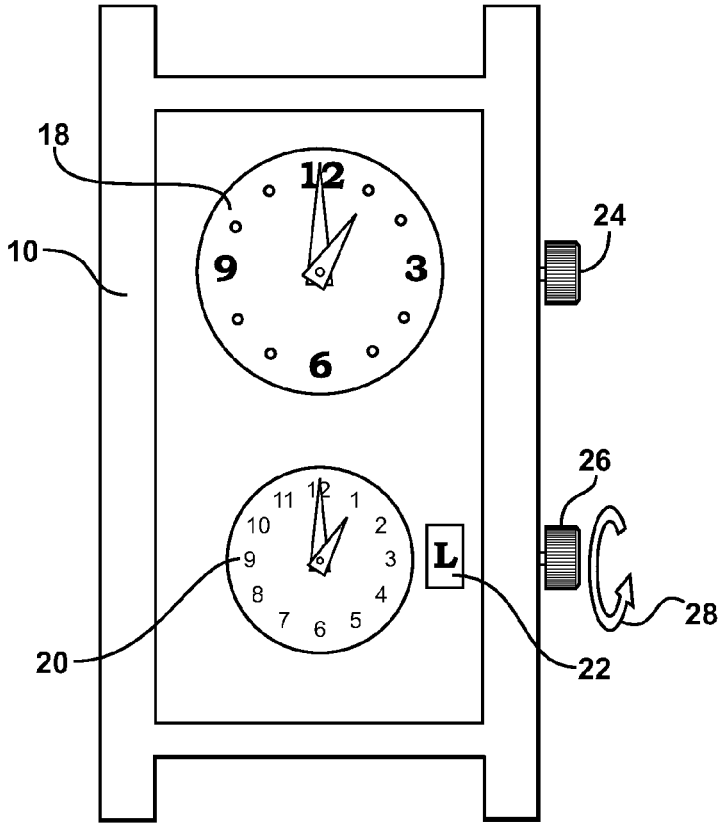
FIG. 3 is a similar illustration and further indicating the features of a bottom static and manually re-adjustable display, this being continuously reset to a time of last feeding.

FIGS. 2-5 illustrate in further detail the protocol surrounding the operation of the breastfeeding wristwatch 10 shown in FIG. 1. Referring first to FIG. 2, an illustration is shown similar to that in FIG. 1 and further indicating the features of the bottom static and manually re-adjustable display 20 being iteratively and manually reset, via associated two position reset dial 26, to a time of last feeding. As such the bottom display 20 does not advance unless prompted by the user.

Each time the user breastfeeds, the user resets the bottom display 20 to the time of the feeding via dial 26. By the example shown in FIG. 3, breast feeding started at 1:00 pm (which is indicated on the upper dial 18) and, hence, the lower time display 20 is reset to this time (see also arrow 28).

Figure 4:
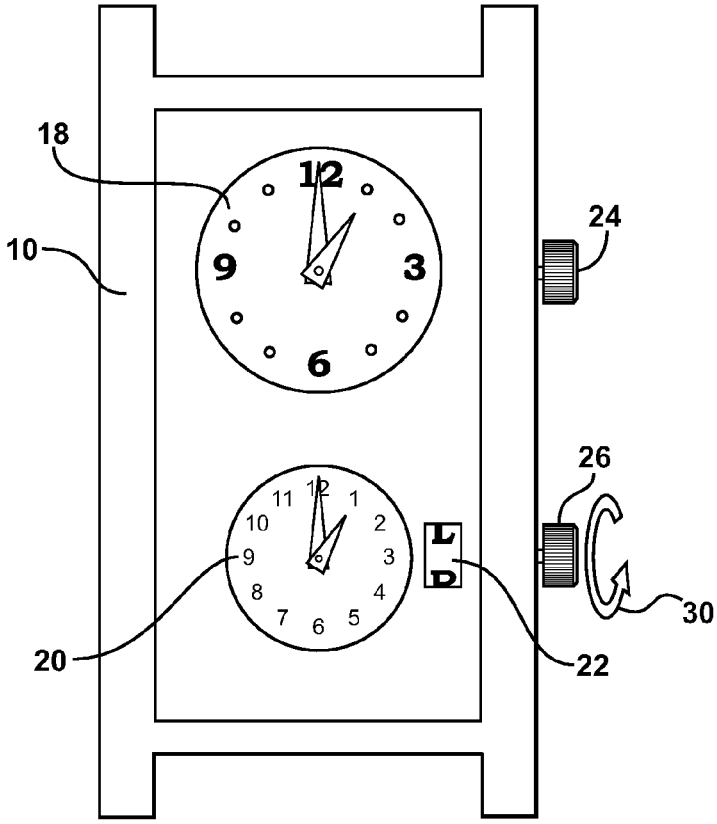
FIG. 4 is a further succeeding illustration and showing the feature of the Left/Right indicator.

As further shown in FIG. 4, the feature of a Left/Right (breast) side indicator is again shown, at 22, and which is iterated between "L" and "R" side designations, such as by repositioning the reset dial 26 to a second position. The indicator 22 is successively reset by the dial 26 (see arrow 30 which differs from arrow 28 in FIG. 3 in that it represents the second adjustment position associated with dial 26), each time the user breast feeds, to the last breast at which feeding initiated (i.e. either the left or right).

It is also noted that the baby may feed from both breasts at a given feeding. The present invention allows breast feeding person to keep track of which side feeding started on in order to ensure 1) fully emptying at least one breast and 2) alternating sides to ensure balanced milk production.

Figure 5:
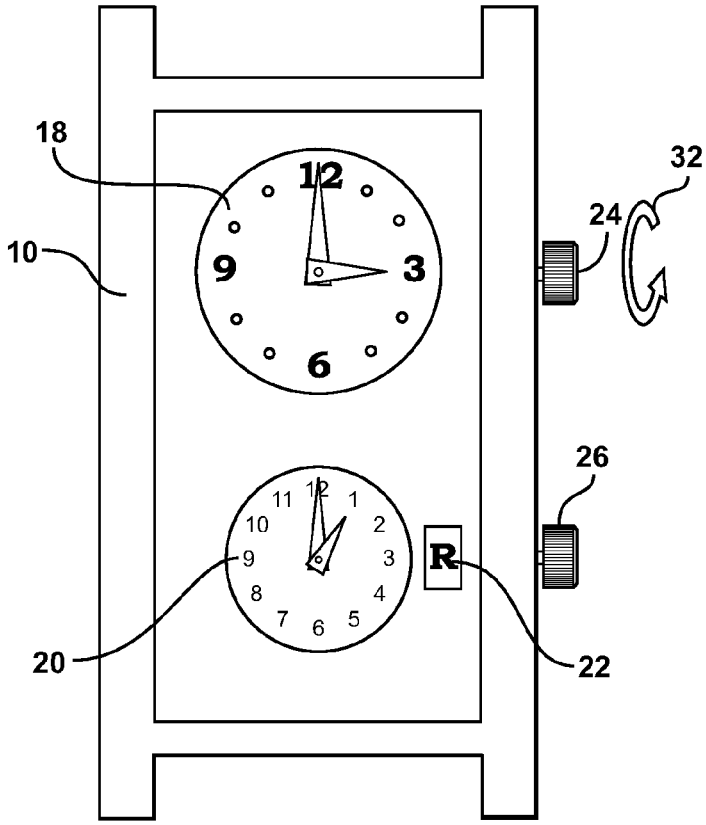
FIG. 5 is an illustration showing the manner in which the present device operates in a first predictive fashion to estimate a future expected feeding time (based upon the last feeding time indicated on the statically reset dial), as well as a second cadence indicating fashion in which, by indicating which side (left or right breast) was previously employed at the commencement of the last feeding, what side is preferred at the initiation of the next feeding (the alternate)

FIG. 5 is a further illustration showing the manner in which the present device operates in a first predictive fashion to estimate a future expected feeding time (based upon the last feeding time indicated on the statically reset dial). A second cadence promoting fashion also instructs, by indicating which breast was previously employed at the commencement of the last feeding, what side is preferred at the initiation of the next feeding (the alternate). Upper arrow 32 also represents the optional readjustment aspect of the dial 24 relative to the live/dynamic display and on an as-needed basis.

In the example illustrated, and as time progresses, the user can reference the lower (statically reset) display 20 to recall how much time has elapsed since the last breast feeding occurred. As illustrated, the last feeding was at 1:00 (again display 20), and which was 2 hours earlier than the current indicated time (3:00) indicated by the upper (live) display 18. This feature helps to predict the time for the next feeding, as well as providing for better interpretive analysis of the baby's crying. Additionally, the breast feeding person can reference the L/R indicator to know which side the baby was last initially fed on, and hence, which side is preferred for the upcoming feeding (the other breast).

The left/right indicator is manually adjusted in this fashion, and thereby establishes a pattern, or cadence, this allowing the mother to keep track of which is the appropriate breast to use initially during feeding. Further, the left/right indicator supports two distinct methodologies of breastfeeding (among potentially others); single breast per feeding or both (dual) breasts per feeding. The former consists of the mother offering only one breast to the infant for a given feeding and then alternating which side is offered at the next feeding (e.g., ~3 hours later). Symbolically, this may be shown as:

L, R, L, R, L, R, etc.

Where each letter representing left or right constitutes a single feeding separated by commas in the above series. The latter method (both breasts per feeding) is believed to be more healthful for the infant as it ensures that the baby ingests hind-milk (see below) as it guarantees that the infant will completely empty the first breast (e.g. left) before continuing feeding on the second breast (e.g. right). Again, in this methodology, the mother alternates sides from which to initiate feeding and this may be symbolically described as:

L-R, R-L, L-R, R-L, etc.

Most importantly, the left/right indicator of the invention supports both, or other, methodologies, and hence, is an advancement over prior art. In particular, the dual breast cadence has not previously been supported effectively elsewhere.

It has been well documented that managing breast feeding cadence imparts significant health benefits for the infant. In particular, it is known from available medical research the importance of ensuring that the infant ingests hind-milk (this being released at the end of the feeding from a given breast), and which is known to have a higher fat content as compared to foremilk (this released by a given breast at the start of the feeding). The further significance of hind-milk is that it contains a predominant amount of the calories and nutrients (as compared to foremilk), this further having been documented to reduce colic and critical in avoiding lactose mal-absorption, a painful condition which can cause malnutrition and diarrhea in the infant.

Figure 6:
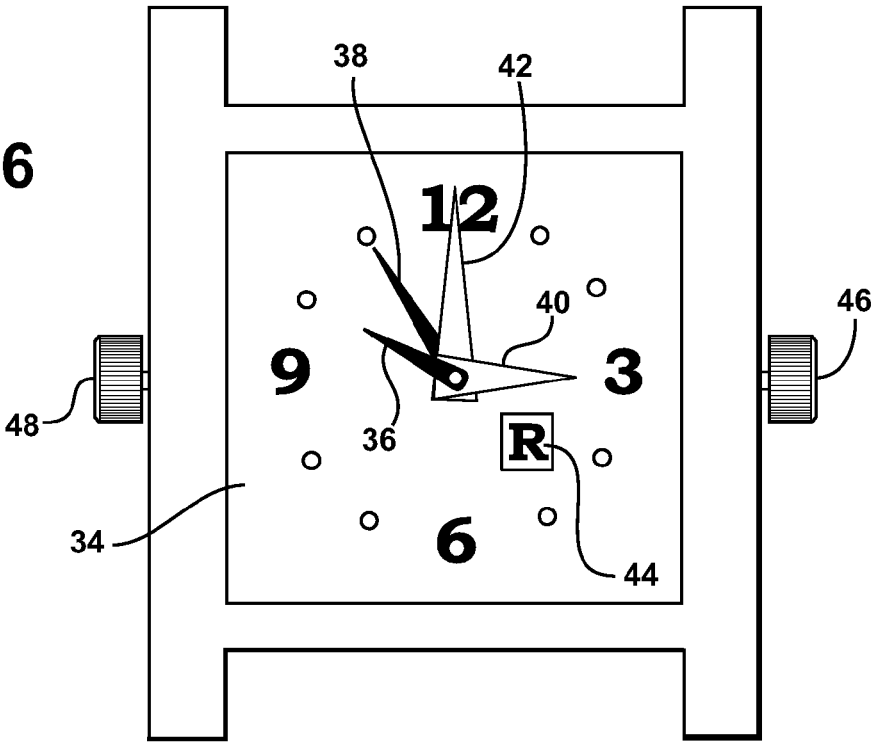
FIG. 6 is an illustration of a further variant in which static and dynamic analog displays are superimposed on a dial face, combined with a separate left/right side indicator.

Referring to each of FIGS. 6-10, a series of alternate variants are depicted of the breastfeeding watch. Beginning with FIG. 6, illustrated is a further variant in which a redesigned display face 34 incorporates both static (hour hand 36 and minute hand 38) and dynamic (hour hand 40 and minute hand 42) analog displays which are superimposed on a common supporting axis associated with the dial face 34, and combined with a separate left/right side indicator 44.

To avoid confusion, the respective pairs of dynamic and static hands can be designed or dimensional differently (e.g. different shapes or sizes), or can be colored differently, such as by selecting easily differentiable colors (e.g. red and black respectively). It is also envisioned that either or both of the pairs of arms can include phosphorescent or fluorescent capabilities, in order to assist in being easily visible in the dark. Without limitation, appropriate backlighting capabilities can also be incorporated into any of the watch casings disclosed in the several embodiments herein.

A right side located dial 46 adjusts in either of first and second positions the static hour 36 and minute 38 hands, as well as the left/right indicator 44. A left side located dial 48 is also provided for resetting the dynamic hands 40 and 42.

Figure 7:
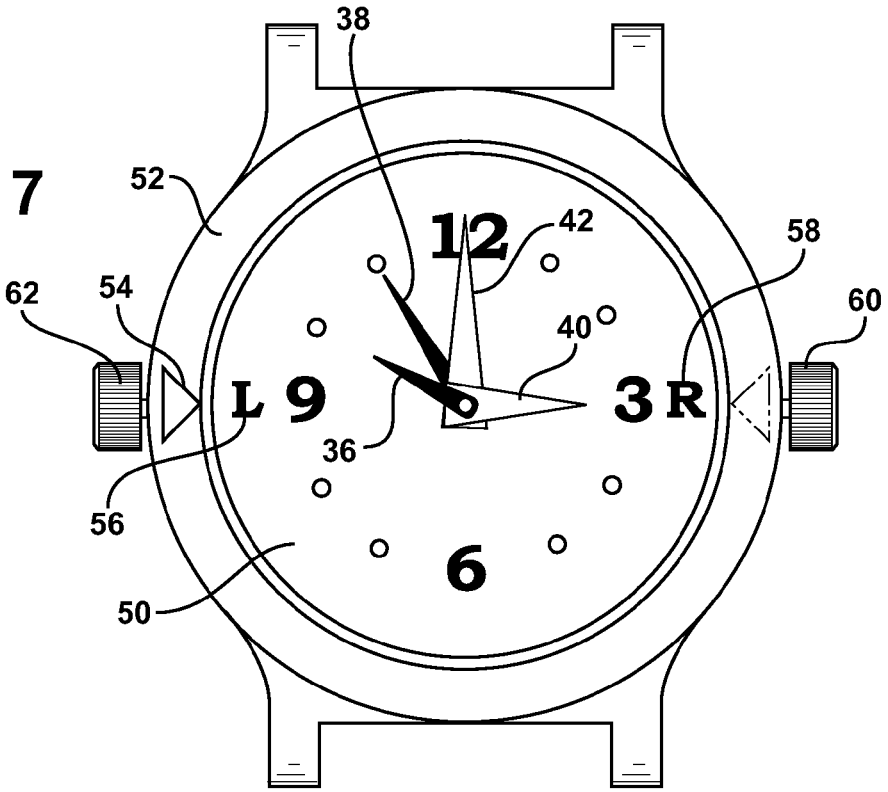
FIG. 7 illustrates another variant combining the superimposed analog displays of FIG. 6 with a rotating left/right indicating bezel.

FIG. 7 illustrates another variant in which a redesigned (rounded) face 50 combines the superimposed analog displays of FIG. 6 (see again static hands 36 and 38 with dynamic hands 40 and 42). The indicator 44 in FIG. 6 is removed and is substituted by a rotatable and outer ring shaped bezel 52, this further including an arrow, or other indicating feature, designation 54 which is rotated 180° between a first position (shown) in which it aligns with a left side indicia marking 56 and a second position (shown in phantom) in which it further aligns with a right side indicia marking 58.

The rotating bezel and left and right side indicia, can incorporate other types of indicator markings, not limited to the use of color coding or shapes, and can include such as jewels (crystals) placed on left and right sides of the dial face in substitution to that shown. Hence, such left and right side indicia may be explicitly represented with letters L and R or implicitly with jewels or other markers, located on the left and right side of the timepiece, accordingly. Additional features include one position adjustment dial 60 for resetting static arms 36 and 38, as well as corresponding dial 62 for resetting dynamic hands 40 and 42.

Figure 8:
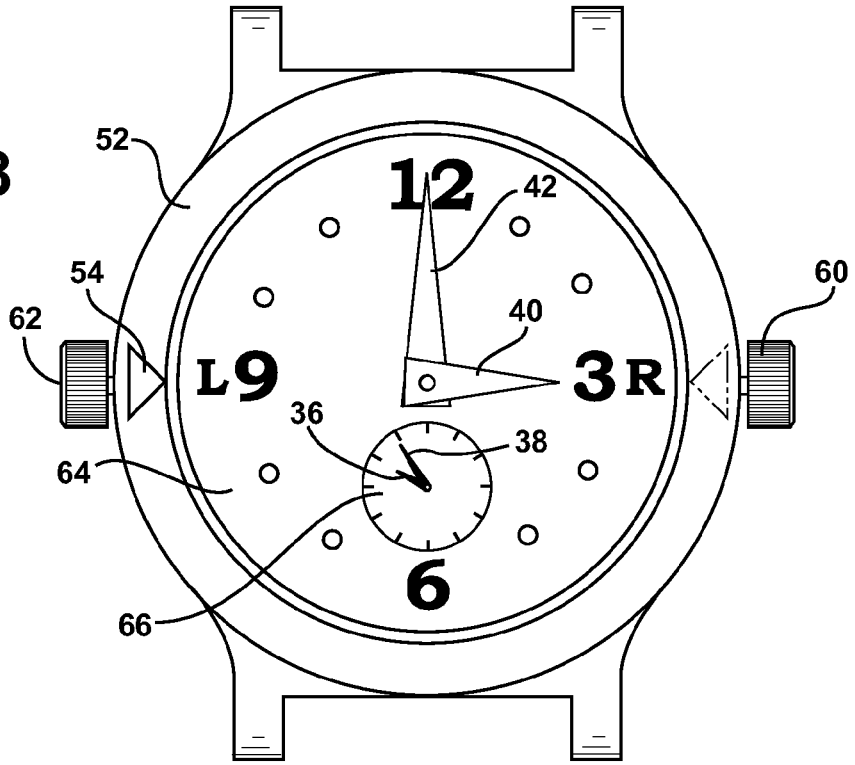
FIG. 8 is illustrates another variant in which the rotating bezel of FIG. 7 is combined with a static inset analog display in the form of a small dial.

Referring now to FIG. 8, illustrated is another variant in which the rotating bezel 52 of FIG. 7 is combined with a redesigned casing and face 64 in which the analog hands 40 and 42 are combined with a redesigned and static smaller sized inset analog display 66. Adjustment dials 60 and 62 are repeated from FIG. 7 and function similarly in this variant. It is also envisioned that the rotating bezel can be substituted in favor of a left/right window display such as is previously shown at 44 in FIG. 6.

Figure 9:
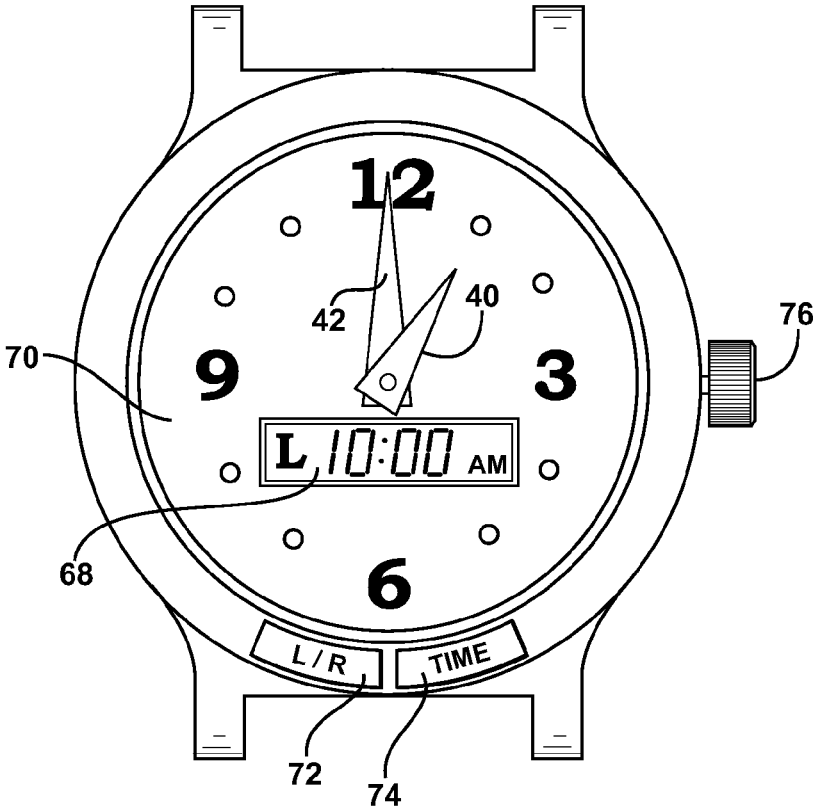
FIG. 9 illustrates another variant in which the static analog display of FIG. 8 is substituted by a digital inset display combined with a left/right breast indicator and which is (re) set by a pair of push buttons located along the bottom of the bezel display.

FIG. 9 illustrates another variant in which the static analog display of FIG. 8 is substituted by a digital inset display 68 combining a left/right breast indicator and incorporated into a further revised display 70. A pair of push buttons are provided and include L/R button 72 and time button 74, these being located along the bottom of a bezel display and which are individually depressible in order the L/R and time components of the combined display 68 are controlled and manipulated. Dial 76 is also provided along a side of the casing to set the actual hands 40 and 42.

Figure 10:
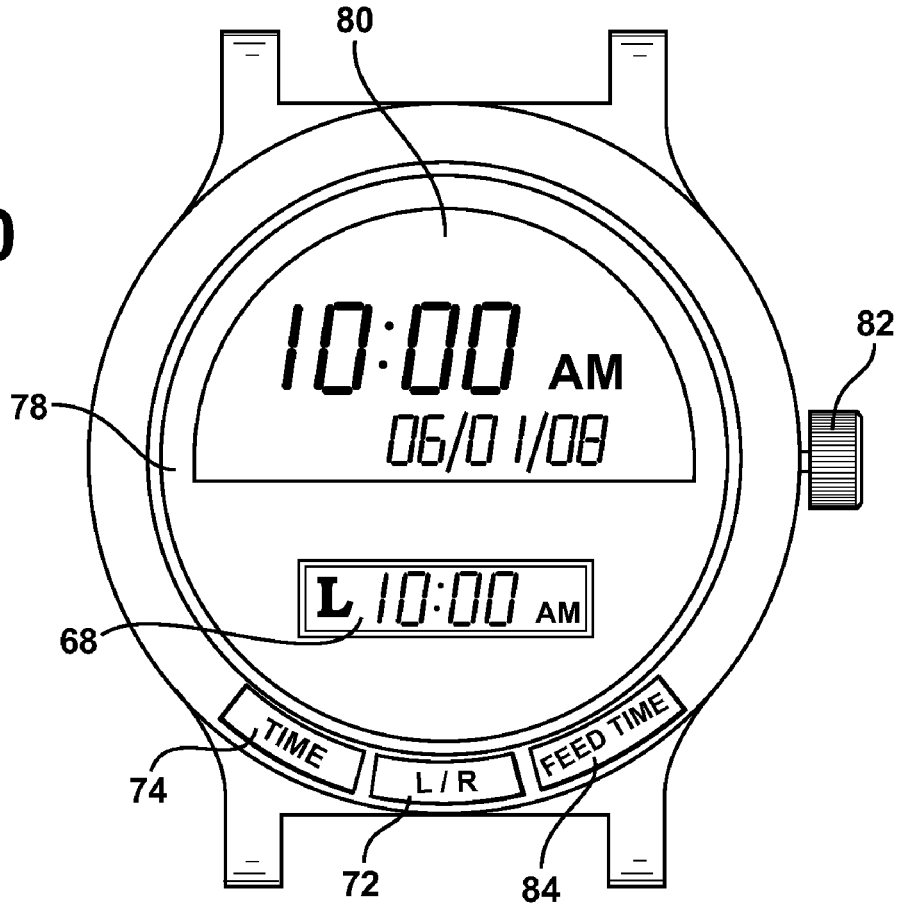
FIG. 10 illustrates a still further variant in which both dynamic and static displays are provided in digital fashion upon a dial face.

Finally, FIG. 10 illustrates a still further variant in which a combined casing and face 78 incorporates both a dynamic digital display 80 in combination with the digital static display 68 previously shown in FIG. 9. Features include the actual time 80 also including a date indication and which is reset by dial 82. L/R and Time buttons 72 and 74 are again illustrated along a bottom of the display. Additionally provided is a feed time button 84 and which can optionally trigger the static display 68 to operate as a live/dynamic display. The feed time 84 can also function as a chronograph (i.e., to show the elapsed time when the button is depressed).

Having described my invention, other and additional preferred embodiments will become apparent to those skilled in the art to which it pertains, and without deviating from the scope of the appended claims.

I claim:

1. A breastfeeding assist watch, comprising:

a casing exhibiting a display face;

a pair of first and second end engageable straps portions extending from opposite ends of said casing;

a first pair of analog hour and minute hands corresponding to first live time display;

a second pair of analog hour and minute hands corresponding to a resettable static time display located on a separate analog face from said first live time display;

a left/right side indicator defined at a further location of said casing and further comprising a rotatable and outer bezel ring incorporating a directional indicator which is selectively aligned with either of first and second indicated positions on said display face; and said static time display being continuously reset to a time of a most recently completed feeding, said left/right side indicator further designating a left or right breast employed first in the most recent feeding and in order to more accurately predict the timing of a present or future feeding, as well as which breast to be initially employed in that feeding.

2. The invention as described in claim 1, said casing having a specified shape and size and further comprising said left/right side indicator being set to correspond to a breast employed during a start of a multiple/cadence feeding.

3. The invention as described in claim 1, further comprising at least a first adjustment dial for resetting said live display.

4. The invention as described in claim 3, further comprising a second adjustment dial for resetting said static time display and said left/right side indicator.

5. A breastfeeding wristwatch comprising:

a timebase measuring time;

a first analog display comprising an hour hand and a minute hand;

the hour hand and minute hand display a current time measured by the timebase;

a second analog display comprising an additional hour hand and an additional minute hand;

the additional hour hand and additional minute hand are operable to be set to a current time indicated by the hour hand and the minute hand, the additional hour hand and additional minute hand are otherwise undriven;

an indicator for selectably indicating either of a left or a right breast;

the indicator is located adjacent the second analog display;

the first analog display, second analog display, and indicator are located on a common display face, but do not overlap; and the second analog display is smaller than the first display.

* * * * *